US011679041B2

(12) United States Patent
Patmore et al.

(10) Patent No.: US 11,679,041 B2
(45) Date of Patent: Jun. 20, 2023

(54) PATIENT TRANSPORT APPARATUS WITH AUXILIARY WHEEL ASSEMBLY

(71) Applicant: Stryker Corporation, Kalamazoo, MI (US)

(72) Inventors: Kevin M. Patmore, Plainwell, MI (US); Henry Kuhnen, Mount Pleasant, SC (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 17/460,650

(22) Filed: Aug. 30, 2021

(65) Prior Publication Data

US 2021/0386603 A1 Dec. 16, 2021

Related U.S. Application Data

(63) Continuation of application No. 16/204,100, filed on Nov. 29, 2018, now Pat. No. 11,129,760.

(60) Provisional application No. 62/592,940, filed on Nov. 30, 2017.

(51) Int. Cl.

| | |
|---|---|
| ***A61G 1/02*** | (2006.01) |
| ***A61G 7/05*** | (2006.01) |
| ***A61G 7/08*** | (2006.01) |

(52) U.S. Cl.

CPC ..... *A61G 1/0268* (2013.01); *A61G 1/0237* (2013.01); *A61G 7/0528* (2016.11); *A61G 7/08* (2013.01)

(58) Field of Classification Search

CPC .. A61G 1/0268; A61G 1/0237; A61G 7/0528; A61G 7/08; A61G 1/00; A61G 1/02

See application file for complete search history.

(56) References Cited

U.S. PATENT DOCUMENTS

| | | | |
|---|---|---|---|
| 5,348,326 | A | 9/1994 | Fullenkamp et al. |
| 5,806,111 | A | 9/1998 | Heimbrock et al. |
| 5,987,671 | A | 11/1999 | Heimbrock et al. |
| 6,256,812 | B1 | 7/2001 | Bartow et al. |
| 6,330,926 | B1 | 12/2001 | Heimbrock et al. |
| 7,062,805 | B2 | 6/2006 | Hopper et al. |
| 8,781,677 | B2 | 7/2014 | Roberts et al. |
| 9,107,783 | B2 | 8/2015 | Childs et al. |
| 10,123,921 | B2 | 11/2018 | Paul |
| 10,797,524 | B2 | 10/2020 | Titov et al. |

(Continued)

OTHER PUBLICATIONS

United States Non-Provisional U.S. Appl. No. 16/168,089, filed Oct. 23, 2018.

(Continued)

*Primary Examiner* — Fredrick C Conley

(74) *Attorney, Agent, or Firm* — Howard & Howard Attorneys PLLC

(57) ABSTRACT

A patient transport apparatus transports a patient over a surface. The patient transport apparatus comprises a base and support wheels coupled to the base. An auxiliary wheel assembly is coupled to the base and comprises one or more auxiliary wheels that influence motion of the patient transport apparatus over the surface to assist caregivers. An actuator system is operatively coupled to the auxiliary wheels to move the auxiliary wheels relative to the base from a stowed position to a first deployed position, and further to a second deployed position.

19 Claims, 7 Drawing Sheets

(56) References Cited

U.S. PATENT DOCUMENTS

| | | | | |
|---|---|---|---|---|
| 2003/0159861 | A1 | 8/2003 | Hopper et al. | |
| 2007/0245488 | A1 | 10/2007 | Zimbalista et al. | |
| 2012/0198620 | A1 | 8/2012 | Hornbach et al. | |
| 2015/0014959 | A1 | 1/2015 | Youngmann et al. | |
| 2016/0089283 | A1 | 3/2016 | DeLuca et al. | |
| 2016/0137216 | A1 | 5/2016 | Nilsson et al. | |
| 2017/0020755 | A1 | 1/2017 | Paul | |
| 2017/0065474 | A1 | 3/2017 | Trepanier et al. | |
| 2017/0172821 | A1* | 6/2017 | Childs | A61G 1/0275 |
| 2018/0250178 | A1 | 9/2018 | Paul et al. | |
| 2019/0125602 | A1 | 5/2019 | Patmore et al. | |
| 2019/0167494 | A1 | 6/2019 | Patmore et al. | |

OTHER PUBLICATIONS

United States Non-Provisional U.S. Appl. No. 16/168,212, filed Oct. 23, 2018.
United States Non-Provisional U.S. Appl. No. 16/204,100, filed Nov. 29, 2018.
United States U.S. Appl. No. 62/592,940, filed Nov. 30, 2017.
United States Provisional U.S. Appl. No. 62/576,303, filed Oct. 24, 2017.
United States Provisional U.S. Appl. No. 62/576,317, filed Oct. 24, 2017.

* cited by examiner

PATIENT TRANSPORT APPARATUS WITH AUXILIARY WHEEL ASSEMBLY

RELATED APPLICATIONS

This application is a Continuation of U.S. patent application Ser. No. 16/204,100, filed on Nov. 29, 2018, which claims priority to and the benefit of U.S. Provisional Patent Application No. 62/592,940, filed on Nov. 30, 2017, the disclosures of each of which are hereby incorporated by reference herein in their entirety.

BACKGROUND

Patient transport systems facilitate care of patients in a health care setting. Patient transport systems comprise patient transport apparatuses such as, for example, hospital beds and stretchers, to move patients between locations. A conventional patient transport apparatus comprises a base, a patient support surface, and several support wheels, such as four swiveling caster wheels. Often, the patient transport apparatus has one or more non-swiveling auxiliary wheels, in addition to the four caster wheels. The auxiliary wheels, by virtue of their non-swiveling nature, are employed to help control movement of the patient transport apparatus over a floor surface in certain situations.

When a caregiver wishes to use the auxiliary wheels to help control movement of the patient transport apparatus, such as down long hallways or around corners, the caregiver moves the auxiliary wheels from a stowed position, out of contact with the floor surface, to a deployed position in contact with the floor surface. This is usually accomplished with a foot pedal that deploys the auxiliary wheels through a mechanical linkage. In many cases, it's desirable for the auxiliary wheels to lift a pair of the caster wheels off the floor surface to enhance the maneuverability of the patient transport apparatus. However, if a load to be carried by the auxiliary wheels is large, a large amount of force is required to be applied to the foot pedal by the caregiver to lift the pair of caster wheels off the floor surface. This can result in the caregiver failing to fully actuate the auxiliary wheel assembly, e.g., false deployments, and thus not experience the benefits of the auxiliary wheel assembly.

A patient transport apparatus designed to overcome one or more of the aforementioned challenges is desired.

DETAILED DESCRIPTION

Figure 1:
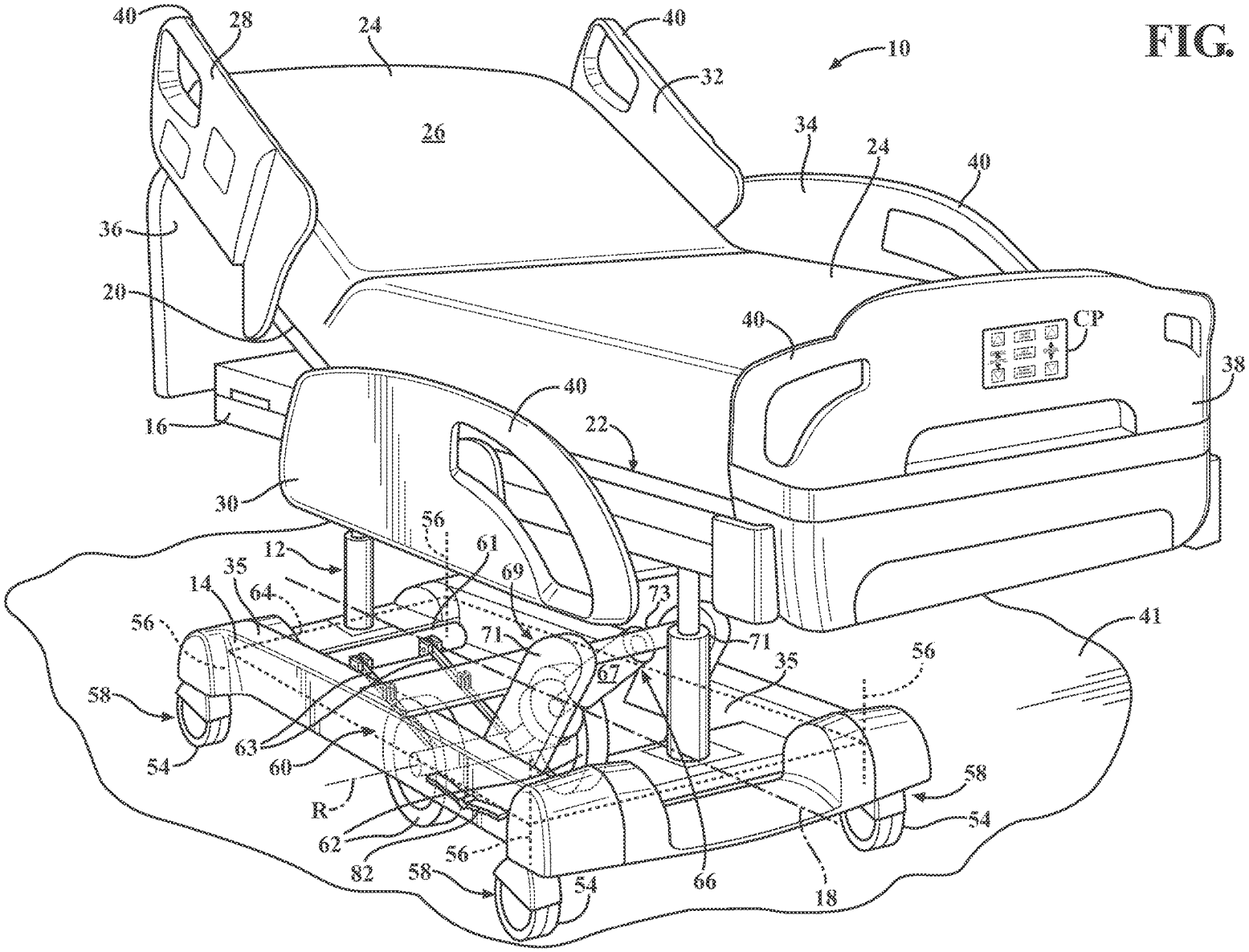
FIG. 1 is perspective view of a patient transport apparatus.

Referring to FIG. 1, a patient transport system comprising a patient transport apparatus 10 is shown for supporting a patient in a health care setting. The patient transport apparatus 10 illustrated in FIG. 1 comprises a hospital bed. In other embodiments, however, the patient transport apparatus 10 may comprise a stretcher, or similar apparatus, utilized in the care of a patient to transport the patient between locations.

A support structure 12 provides support for the patient. The support structure 12 illustrated in FIG. 1 comprises a base 14 and an intermediate frame 16. The base 14 defines a longitudinal axis 18 from a head end to a foot end. The intermediate frame 16 is spaced above the base 14. The support structure 12 also comprises a patient support deck 20 disposed on the intermediate frame 16. The patient support deck 20 comprises several sections, some of which articulate (e.g., pivot) relative to the intermediate frame 16, such as a fowler section, a seat section, a thigh section, and a foot section. The patient support deck 20 provides a patient support surface 22 upon which the patient is supported.

A mattress 24 is disposed on the patient support deck 20. The mattress 24 comprises a secondary patient support surface 26 upon which the patient is supported. The base 14, intermediate frame 16, patient support deck 20, and patient support surfaces 22, 26 each have a head end and a foot end corresponding to designated placement of the patient's head and feet on the patient transport apparatus 10. The construction of the support structure 12 may take on any known or conventional design, and is not limited to that specifically set forth above. In addition, the mattress 24 may be omitted in certain embodiments, such that the patient rests directly on the patient support surface 22.

Side rails 28, 30, 32, 34 are supported by the base 14. A first side rail 28 is positioned at a right head end of the intermediate frame 16. A second side rail 30 is positioned at a right foot end of the intermediate frame 16. A third side rail 32 is positioned at a left head end of the intermediate frame 16. A fourth side rail 34 is positioned at a left foot end of the intermediate frame 16. If the patient transport apparatus 10 is a stretcher, there may be fewer side rails. The side rails 28, 30, 32, 34 are movable between a raised position in which they block ingress and egress into and out of the patient transport apparatus 10 and a lowered position in which they are not an obstacle to such ingress and egress. The side rails 28, 30, 32, 34 may also be movable to one or more intermediate positions between the raised position and the lowered position. In still other configurations, the patient transport apparatus 10 may not comprise any side rails.

A headboard 36 and a footboard 38 are coupled to the intermediate frame 16. In other embodiments, when the headboard 36 and footboard 38 are provided, the headboard 36 and footboard 38 may be coupled to other locations on the patient transport apparatus 10, such as the base 14. In still other embodiments, the patient transport apparatus 10 does not comprise the headboard 36 and/or the footboard 38.

Caregiver interfaces 40, such as handles, are shown integrated into the footboard 38 and side rails 28, 30, 32, 34 to facilitate movement of the patient transport apparatus 10 over floor surfaces 41. Additional caregiver interfaces 40 may be integrated into the headboard 36 and/or other components of the patient transport apparatus 10. The caregiver interfaces 40 are graspable by the caregiver to manipulate the patient transport apparatus 10 for movement.

Other forms of the caregiver interface 40 are also contemplated. The caregiver interface may comprise one or more handles coupled to the intermediate frame 16. The caregiver interface may simply be a surface on the patient transport apparatus 10 upon which the caregiver logically applies force to cause movement of the patient transport apparatus 10 in one or more directions, also referred to as a push location. This may comprise one or more surfaces on the intermediate frame 16 or base 14 This could also comprise one or more surfaces on or adjacent to the headboard 36, footboard 38, and/or side rails 28, 30, 32, 34. In other embodiments, the caregiver interface may comprise separate handles for each hand of the caregiver. For example, the caregiver interface may comprise two handles.

Support wheels 54 are coupled to the base 14 to support the base 14 on a floor surface such as a hospital floor. The support wheels 54 allow the patient transport apparatus 10 to move in any direction along the floor surface 41 by swiveling to assume a trailing orientation relative to a desired direction of movement. In the embodiment shown, the support wheels 54 comprise four support wheels each arranged in corners of the base 14. The support wheels 54 shown are caster wheels able to rotate and swivel about swivel axes 56 during transport. Each of the support wheels 54 forms part of a caster assembly 58. Each caster assembly 58 is mounted to the base 14. It should be understood that various configurations of the caster assemblies 58 are contemplated. In addition, in some embodiments, the support wheels 54 are not caster wheels and may be non-steerable, steerable, non-powered, powered, or combinations thereof. Additional support wheels 54 are also contemplated.

An auxiliary wheel assembly 60 is coupled to the base 14. The auxiliary wheel assembly 60 influences motion of the patient transport apparatus 10 during transportation over the floor surface 41. The auxiliary wheel assembly 60 comprises a pair of auxiliary wheels 62 and an actuator system 66 operatively coupled to the auxiliary wheels 62. The actuator system 66 is operable to move the auxiliary wheels 62 between various deployed positions in contact with the floor surface 41 and a stowed position spaced away and out of contact with the floor surface 41.

By deploying the auxiliary wheels 62 on the floor surface 41, the patient transport apparatus 10 can be easily moved down long, straight hallways or around corners, owing to a non-swiveling nature of the auxiliary wheels 62. When the auxiliary wheels 62 are stowed (see FIG. 2A), the patient transport apparatus 10 is subject to moving in an undesired direction due to uncontrollable swiveling of the support wheels 54. For instance, during movement down long, straight hallways, the patient transport apparatus 10 may be susceptible to "dog tracking," which refers to undesirable sideways movement of the patient transport apparatus 10. Additionally, when cornering, without the auxiliary wheels 62 deployed, and with all of the support wheels 54 able to swivel, there is no wheel assisting with steering through the corner.

The auxiliary wheels 62 may be arranged parallel to each other and the longitudinal axis 18 of the base 14. Said differently, the auxiliary wheels 62 rotate about a rotational axis R oriented perpendicularly to the longitudinal axis 18 of the base 14 (albeit offset in some cases from the longitudinal axis 18). In the embodiment shown, the auxiliary wheels 62 are incapable of swiveling about a swivel axis and are non-driven, and are also referred to as steer wheels. In other embodiments, the auxiliary wheels 62 may be capable of swiveling, but can be locked in a steer lock position in which they are locked to solely rotate about the rotational axis R oriented perpendicularly to the longitudinal axis 18. In still other embodiments, the auxiliary wheels 62 may be able to freely swivel without any steer lock functionality. In embodiments in which the auxiliary wheels 62 are able to swivel, they may swivel about their own, separate swivel axes, or a common swivel axis of the auxiliary wheel assembly 60. The auxiliary wheel assembly 60 may comprise one, two, or more auxiliary wheels 62.

The auxiliary wheels 62 may be located to be deployed inside a perimeter of the base 14 and/or within a support wheel perimeter 64 defined by the swivel axes 56 of the support wheels 54. In some embodiments, such as those employing a single auxiliary wheel 62, the auxiliary wheel 62 may be located near a center of the support wheel perimeter 64, or offset from the center. In this case, the auxiliary wheel 62 may also be referred to as a fifth wheel. The auxiliary wheels 62 may be longitudinally and equally offset from the center of the support wheel perimeter 64. The auxiliary wheels 62 may also be equally and oppositely offset from the longitudinal axis 18 to be symmetrically positioned with respect to the longitudinal axis 18. In other embodiments, the auxiliary wheels 62 may be disposed along the support wheel perimeter 64 or outside of the support wheel perimeter 64. In the embodiment shown, each of the auxiliary wheels 62 has a diameter larger than a diameter of the support wheels 54. In other embodiments, the auxiliary wheels 62 may have the same or a smaller diameter than the support wheels 54.

Figure 2A:
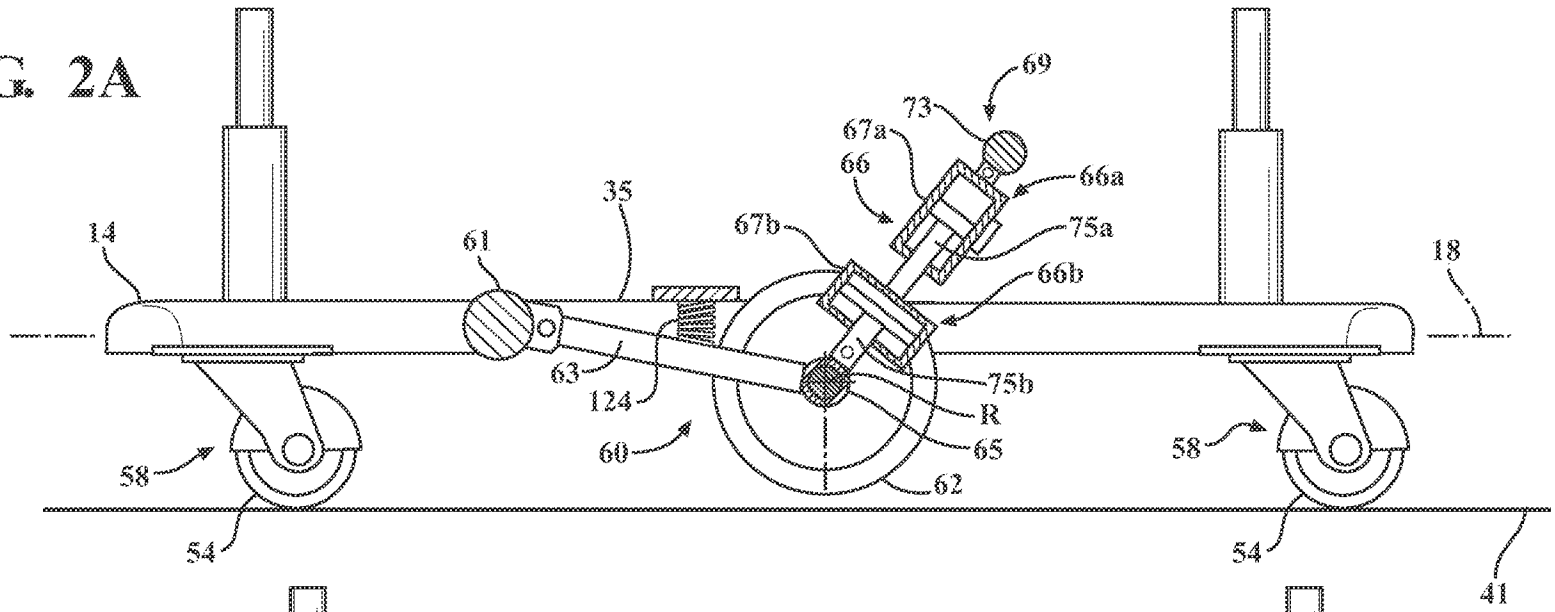
FIG. 2A is an elevational and partially cross-sectional view of the patient transport apparatus in the stowed position.
Figure 2B:
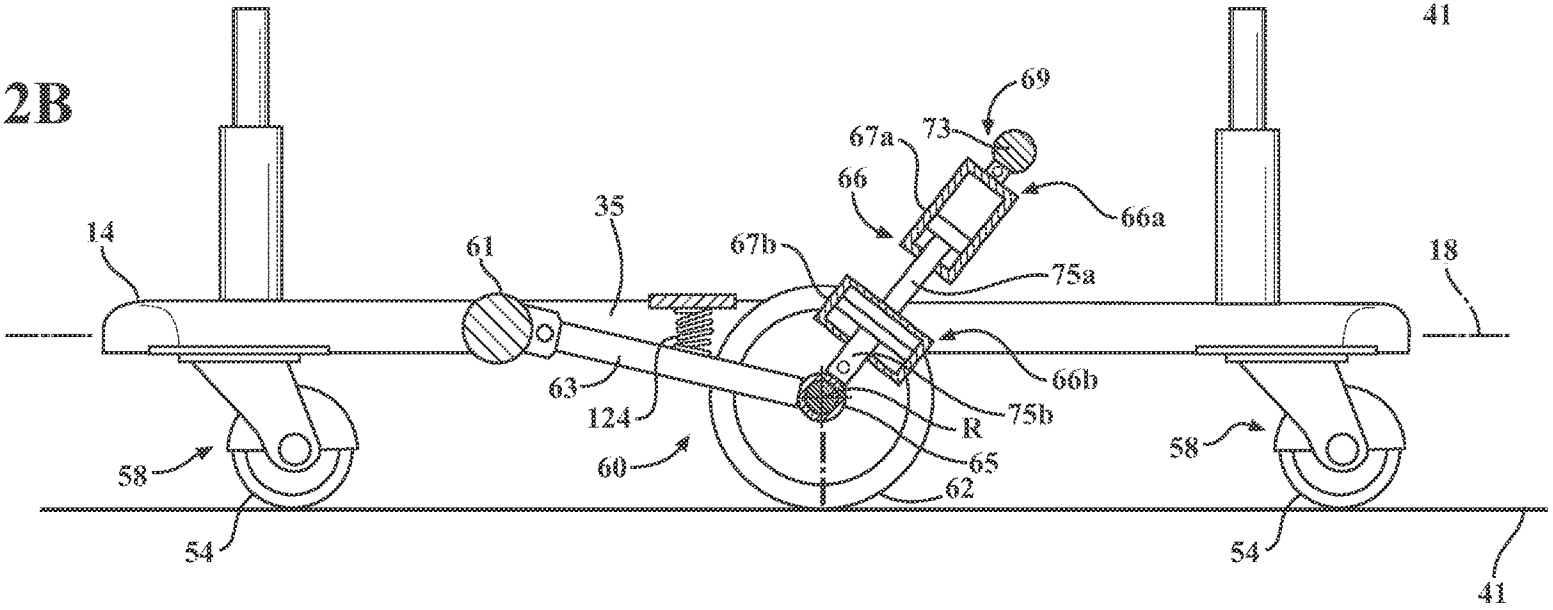
FIG. 2B is an elevational and partially cross-sectional view of the patient transport apparatus in the first deployed position.

Referring to FIG. 2B, in the embodiment shown, the auxiliary wheel assembly 60 comprises a pair of parallel and spaced deployment arms 63 pivotally connected to a first cross member 61. The first cross member 61 is fixed to the base 14. The first cross member 61 extends between two frame members 35 of the base 14. The deployment arms 63 extend from the first cross member 61 to a carriage that supports the auxiliary wheels 62 and rotation of the auxiliary wheels 62. In the embodiment shown, the carriage comprises an axle 65. The axle 65 supports rotation of the auxiliary wheels 62. In the embodiment shown, a central rotating shaft (not numbered) is fixed to the auxiliary wheels 62 to rotate inside the axle 65 about the rotational axis R. In other embodiments, the auxiliary wheels 62 are disposed about the axle 65 with bearings disposed between hubs of the auxiliary wheels 62 and the axle 65 so that the auxiliary wheels 62 are able to rotate about the rotational axis R relative to the axle 65. The deployment arms 63 are fixed to the axle 65 so that the axle 65 is able to pivot relative to the first cross member 61 in concert with pivoting of the deployment arms 63.

Figure 2C:
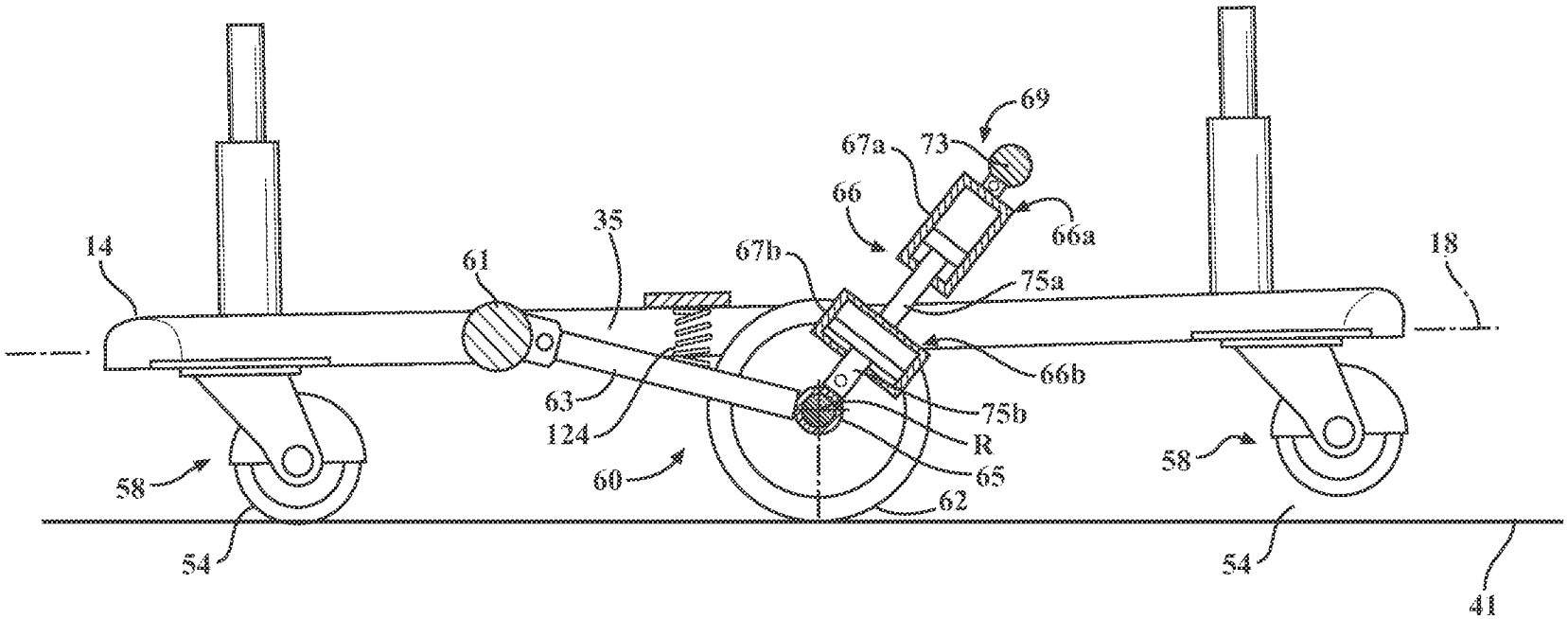
FIG. 2C is an elevational and partially cross-sectional view of the patient transport apparatus in the second deployed position.

In the embodiment shown in FIGS. 2A-2C, the actuator system 66 comprises a first actuation device 66*a* and a second actuation device 66*b*. The actuation devices 66*a*, 66*b* comprise one of an electric actuator, a hydraulic actuator, an electro-hydraulic actuator, a gear mechanism, a transmission, or other suitable types of actuation devices. The actuation devices 66*a*, 66*b* operate to move the auxiliary wheels 62 from the stowed position to deployed positions. For instance, the first actuation device 66*a* operates to move the auxiliary wheels 62 relative to the base 14 from the stowed position (FIG. 2A) in which the auxiliary wheels 62 are spaced above the floor surface 41 to a first deployed position (FIG. 2B) in which the auxiliary wheels 62 make initial contact with the floor surface 41. All the support wheels 54 are arranged to contact the floor surface 41 when the auxiliary wheels 62 are in the first deployed position.

The second actuation device 66*b* operates to move the auxiliary wheels 62 relative to the base 14 from the first deployed position to a second deployed position (FIG. 2C). In the second deployed position, the auxiliary wheels 62 maintain contact with the floor surface 41, but further extend to raise a pair of the support wheels 54 off the floor surface 41, as shown in FIG. 2C. In one embodiment, the auxiliary wheels 62 are extended so that the pair of support wheels 54 are lifted off the floor surface 41 by at least 0.05, 0.10, 0.20, 0.25, 0.30, or 0.35 inches or from a range of from 0.05 to 1.0 inches, from 0.10 to 0.50 inches, or from 0.20 to 0.30 inches (based on a level floor surface 41).

In the first deployed position (FIG. 2B), the auxiliary wheels 62 are configured to collectively support fifty percent or less of a total mass of the patient transport apparatus 10 (with or without patient) since the auxiliary wheels 62 have only made initial contact with the floor surface 41 and the pair of support wheels 54 are not yet lifted off the floor surface 41. In some embodiments, when the pair of support wheels 54 are lifted off the floor surface 41 in the second deployed position, greater than fifty percent of the total mass is supported by the auxiliary wheels 62 with the remainder being supported by the remaining support wheels 54 that stay in contact with the floor surface 41 (two in the embodiment shown).

The first actuation device 66*a* has a first housing 67*a* pivotally coupled to the base 14. More specifically, an actuator support structure 69 extends across the base 14 to support the first housing 67*a*. The actuator support structure 69 comprises a pair of support arms 71 (see FIG. 1) fixed to the frame members 35. The actuator support structure 69 further comprises a second cross member 73 fixed to and extending between the support arms 71. The first housing 67*a* is pivotally connected to the second cross member 73. The first actuation device 66*a* further comprises a first drive rod 75*a* connected to a piston that is driven by the first actuation device 66*a* to extend and retract with respect to the first housing 67*a*. Movement of the first drive rod 75*a* relative to the first housing 67*a* varies the deployment of the auxiliary wheels 62 by virtue of pivoting the axle 65 relative to the first cross member 61 to raise and lower the axle 65.

The second actuation device 66*b* has a second housing 67*b* fixed to the first drive rod 75*a* such that linear movement of the first drive rod 75*a* causes linear movement of the second housing 67*b*. The second actuation device 66*b* further comprises a second drive rod 75*b* connected to a piston that is driven by the second actuation device 66*b* to extend and retract with respect to the second housing 67*b*. Movement of the second drive rod 75*b* relative to the second housing 67*b* varies the deployment of the auxiliary wheels 62 by virtue of further pivoting the axle 65 relative to the first cross member 61 to raise and lower the axle 65.

It should be appreciated that many other configurations of the patient transport apparatus 10 and the auxiliary wheel assembly 60 are possible for controlling deployment of the auxiliary wheels 62. For instance, the actuation devices 66*a*, 66*b* are arranged in series in FIGS. 2A-2C, but could be arranged in parallel, as described further below. In some cases, the actuator system 66 may be rigidly fixed to the base 14 in a vertical arrangement to deploy the auxiliary wheels 62 vertically thereby eliminating the need for any pivot connections. In other cases, spring arrangements may be positioned between the auxiliary wheels 62 and the base 14 to provide some suspension to the auxiliary wheels 62. The arrangement described herein is merely exemplary of one possible arrangement of the auxiliary wheels 62 and their deployment.

The first and second actuation devices 66*a*, 66*b* may operate simultaneously or sequentially to move the auxiliary wheels 62 from the stowed position, to the first deployed position, and then to the second deployed position. The first and second actuation devices 66*a*, 66*b* may be completely independent and able to operate and function separately from one another. In other cases, the first and second actuation devices 66*a*, 66*b* may provide distinct movements of the auxiliary wheels 62, yet be integrated into a single assembly, or can be formed into separate assemblies. In some cases, the first actuation device 66*a* moves the auxiliary wheels 62 a first distance relative to the base 14 and the second actuation device 66*b* moves the auxiliary wheels 62 a second distance relative to the base 14, with the first distance being greater than the second distance.

Figure 3A:
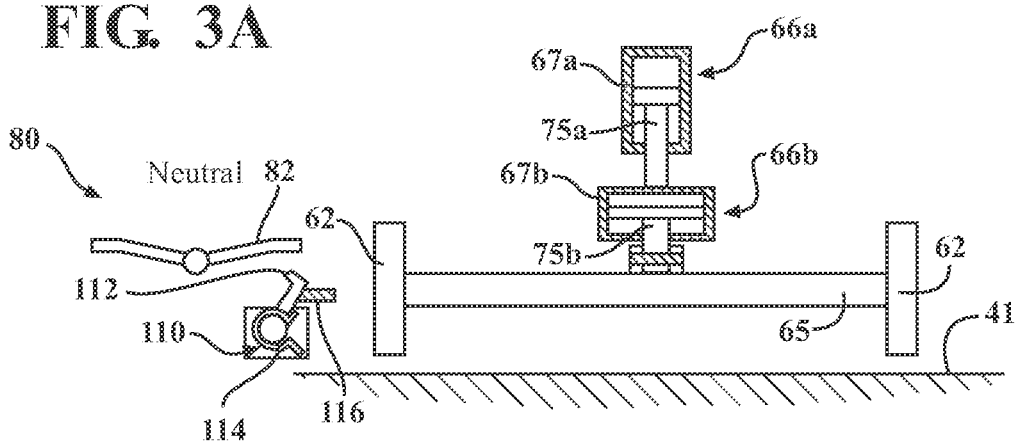
FIGS. 3A-3C illustrate deployment of the auxiliary wheel assembly with hydraulic actuators in series.
Figure 3B:
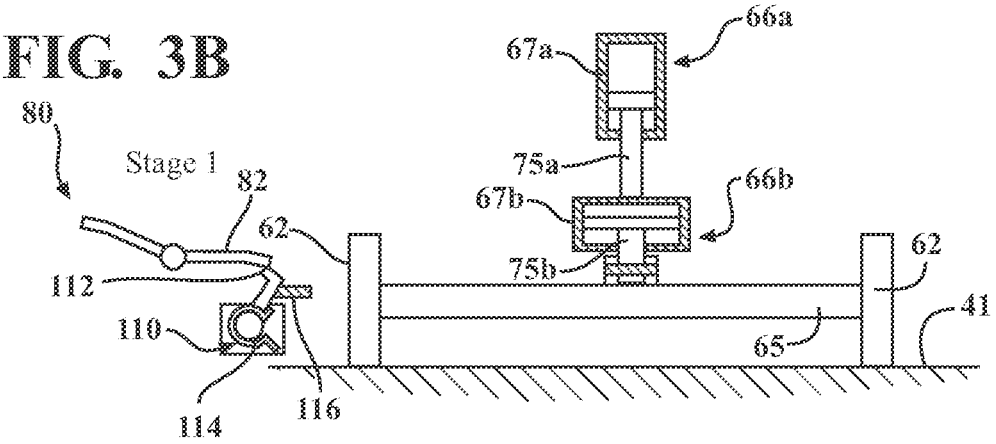
Figure 3C:
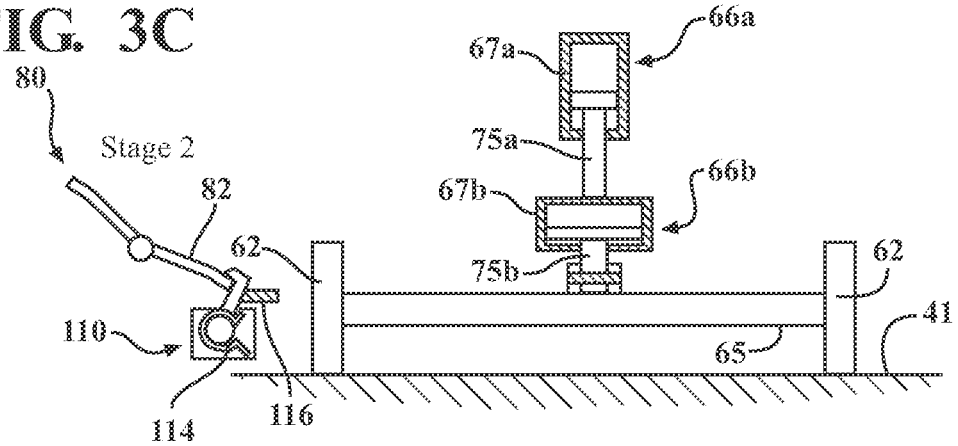

Referring to FIGS. 3A-3C, a control system 80 is provided to control operation of the actuator system 66. The control system 80 comprises an input device operatively coupled to the first and second actuation devices 66*a*, 66*b* to receive input from a user to deploy the auxiliary wheels 62. In the embodiment shown, the input device comprises a foot pedal 82 operable to pivot about a pivot shaft coupled to the base 14. The foot pedal 82 pivots to control the actuation devices 66*a*, 66*b*. Pivoting the foot pedal 82 from a neutral position (FIG. 3A) to a first stage position (FIG. 3B) causes movement of the auxiliary wheels 62 from the stowed position to the first deployed position. Pivoting of the foot pedal 82 from the first stage position to a second stage position (FIG. 3C) causes movement of the auxiliary wheels 62 from the first deployed position to the second deployed position, thereby lifting the pair of support wheels 54 off the floor surface 41. In other embodiments, the input device comprises a hand lever, button, and/or sensor.

In the first stage, illustrated as movement from FIG. 3A to FIG. 3B, the first actuation device 66*a* is operated to move the auxiliary wheels 62 from the stowed position to the first deployed position in which the auxiliary wheels 62 have made initial contact with the floor surface 41 but have not yet been fully loaded such that the pair of support wheels 54 lift off the floor surface 41. In the second stage, illustrated as movement from FIG. 3B to FIG. 3C, the second actuation device 66*b* is operated to move the auxiliary wheels 62 from the first deployed position to the second deployed position such that the pair of support wheels 54 lift off the floor surface 41. See, for example, movement of the drive rods 75*a*, 75*b* illustrated in FIGS. 3A-3C. The control system 80 may be mechanical, electro-mechanical, and the like. In some cases, the control system 80 is entirely mechanical such that no electronic devices are required to deploy the auxiliary wheels 62.

The actuator system 66 is configured in one embodiment to sequence operation of the actuation devices 66*a*, 66*b* such that the first actuation device 66*a* is initially operated to move the auxiliary wheels 62 from the stowed position to the first deployed position, and upon the auxiliary wheels 62 reaching the first deployed position, the second actuation device 66*b* is operated to move the auxiliary wheels 62 from the first deployed position to the second deployed position. In some cases, the transition from the first stage to the second stage is automatic such that no user intervention is required. For example, the automatic transition may be based on sensed loads, pressure, position, and the like. Furthermore, the first actuation device 66*a* may be configured to move the auxiliary wheels 62 in the first stage at a first actuation rate and the second actuation device 66*b* may be configured to move the auxiliary wheels 62 in the second stage at a second actuation rate, slower than the first actuation rate. As a result, the user can quickly move the auxiliary wheels 62 from the stowed position to the first deployed position to quickly start moving the patient transport apparatus 10 down a hallway, but additional deployment to the second deployed position may occur slowly, such as while the patient transport apparatus 10 is being moved.

Figure 4A:
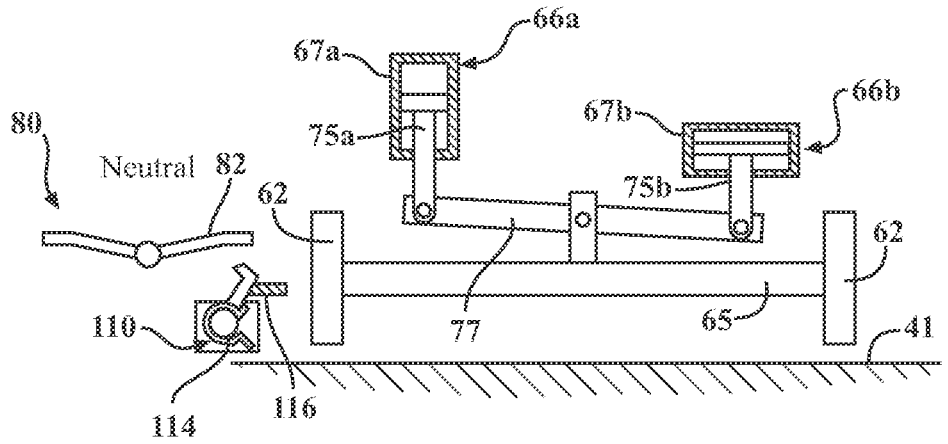
FIGS. 4A-4C illustrate deployment of the auxiliary wheel assembly with hydraulic actuators in parallel.
Figure 4B:
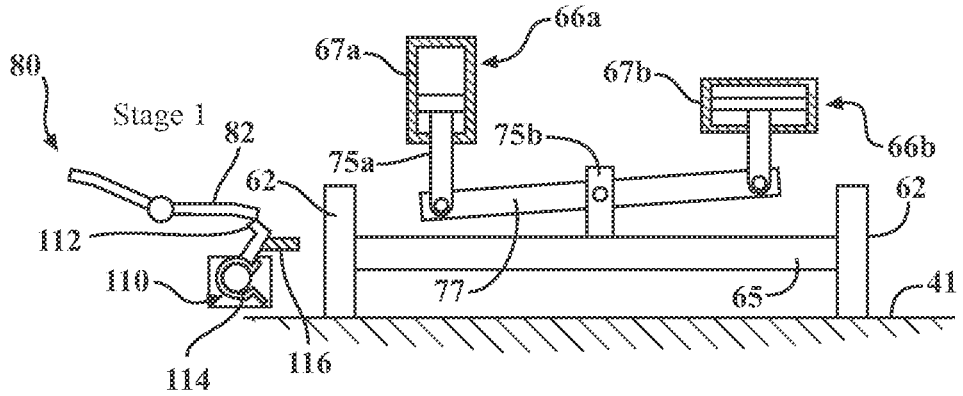
Figure 4C:
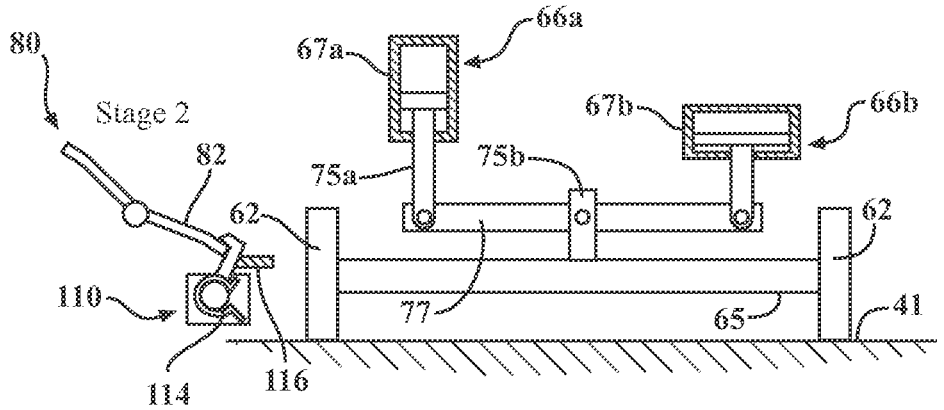

FIGS. 4A-4C illustrate a similar sequence of operation of the actuation devices 66*a*, 66*b*, but with the actuation devices 66*a*, 66*b* arranged in parallel, rather than series. In this embodiment, the housings 67*a*, 67*b* are fixed to the base 14 and operate on a link arm 77 that is pivotally connected to the carriage of the auxiliary wheel assembly 60. In this case, the actuation devices 66*a*, 66*b* may still operate in sequence with the first actuation device 66*a* operating in the first stage to move the link arm 77 downwardly about its center pivot (FIG. 4B), and with the second actuation device 66*b* operating in the second stage to move the link arm 77 downwardly about its center pivot on an opposite side of the link arm 77 (FIG. 4C) so that at the end of the second stage, the link arm 77 is generally horizontal and parallel with the floor surface 41.

The foot pedal 82 is configured to receive an applied force from the user and transmit the applied force into the actuator system 66 to move the auxiliary wheels 62 from the stowed position to the first deployed position, and further to the second deployed position. The first actuation device 66*a* is configured so that a first force is required to be applied by the user to the foot pedal 82 to move the auxiliary wheels 62 from the stowed position to the first deployed position and the second actuation device 66*b* is configured so that a second force is required to be applied by the user to the foot pedal 82 to move the auxiliary wheels 62 from the first deployed position to the second deployed position. In some cases, the first force is substantially the same as the second force, or within 5, 10, 15, or 20% of the second force. The force may be defined as the force applied perpendicular to the lever arm created by the foot pedal 82. The first and second forces may be applied by the user in noticeably discrete motions (e.g., foot presses). In other words, there may be a noticeable transition between a first foot press in which the user applies the first force to depress the foot pedal 82 so that the auxiliary wheels 62 move from the stowed position to the first deployed position and a second foot press in which the user applies the second force to depress the foot pedal 82 so that the auxiliary wheels 62 move from the first deployed position to the second deployed position. This transition may be a subtle increase (or decrease) in the force required to be applied by the user to continue moving the foot pedal 82 or may result from an integrated feedback device (e.g., audible feedback, visual feedback, or other form of haptic feedback). Additionally, or alternatively, the actuation devices 66*a*, 66*b* may be configured so that the force required to be applied by the user to move the auxiliary wheels 62 from the stowed position to the first deployed position and further to the second deployed position remains substantially constant throughout an entire range of movement of the foot pedal 82 so that such a transition is less discernable by the user.

Figure 5:
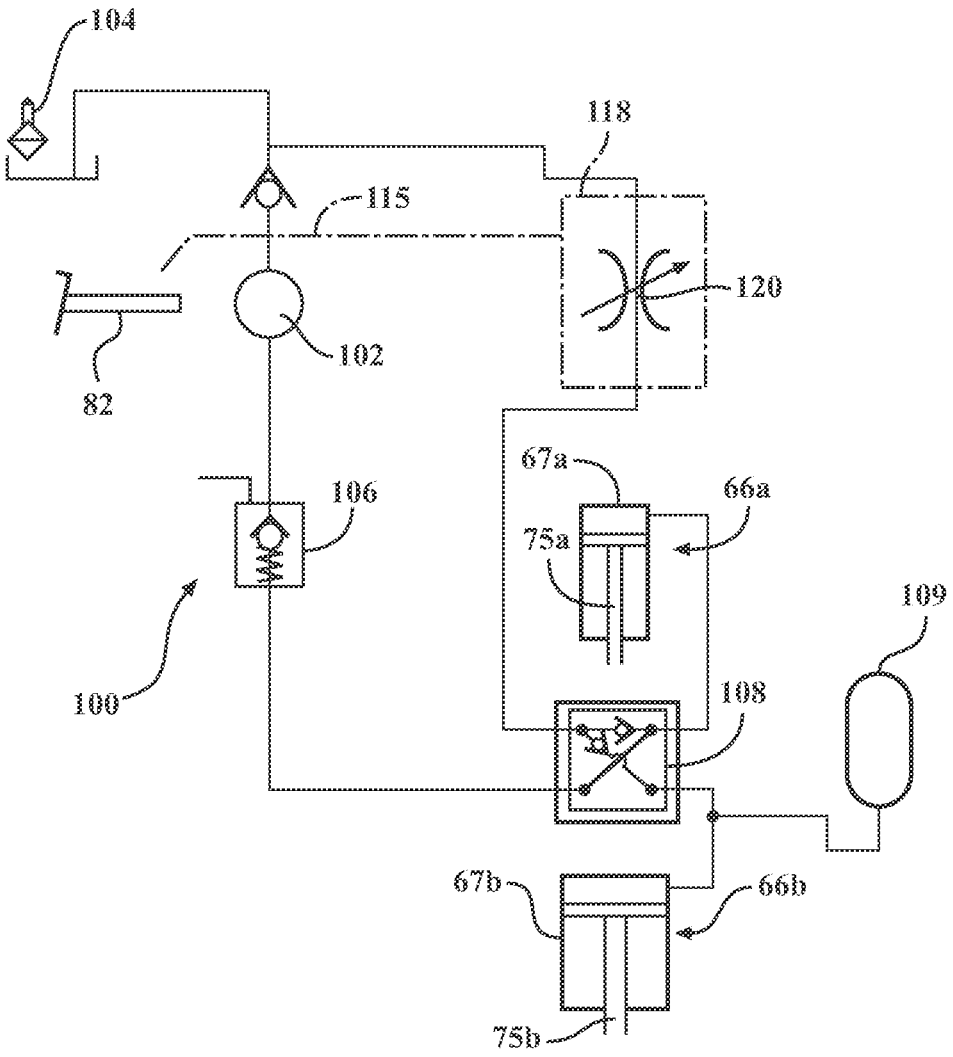
FIG. 5 is a schematic view of a hydraulic circuit.

Referring to FIG. 5, the first and second actuation devices 66*a*, 66*b* may be first and second hydraulic actuators that transmit the force applied to the foot pedal 82 by the user through a hydraulic circuit 100. The hydraulic circuit 100 comprises a hydraulic pump 102 in fluid communication with a fluid reservoir 104. The hydraulic pump 102 is operatively coupled to the foot pedal 82 (or other input device) to be operated by the foot pedal 82. In some cases, the force applied by the user through the foot pedal 82 is mechanically connected to the hydraulic pump 102 such that displacement of the foot pedal 82 causes pumping of the hydraulic fluid. For example, the hydraulic pump 102 may be a simple cylinder with a piston in which the foot pedal 82 acts as a lever to move the piston, either directly, or through a linkage arrangement to provide additional mechanical advantage, such as in a bottle jack for a vehicle. The foot pedal 82 may be required to be moved only one stroke (from the neutral to the second stage position) to fully deploy the auxiliary wheels 62 as described herein, or multiple strokes of the foot pedal 82 may be required to fully deploy the auxiliary wheels 62. Other mechanisms are contemplated to pump the hydraulic fluid in the hydraulic circuit 100.

The hydraulic circuit 100 further comprises a spring-operated check valve 106 to control flow of the hydraulic fluid during movement of the foot pedal 82 and to maintain pressure in the hydraulic circuit 100. When the user begins depressing the foot pedal 82, such as from the neutral position (also referred to as a disengaged state/position) to the first stage (also referred to as an engaged state/position), pumping begins and hydraulic fluid is moved through the spring-operated check valve 106 to the first actuation device 66*a* to cause displacement of the first drive rod 75*a* relative to the first housing 67*a*. As described below, a biasing device 124 (see FIG. 2A) is used to return the auxiliary wheels 62 to the stowed position—and this biasing device 124 provides a force against which the first actuation device 66*a* acts to move the auxiliary wheels 62 from the stowed position to the first deployed position. Once the auxiliary wheels 62 have reached the floor surface 41 and the first deployed position, pressure in the hydraulic circuit 100 between the check valve 106 and the first actuation device 66*a* increases with further actuation of the foot pedal 82 owing to the increased load that will consequently be placed on the first actuation device 66*a*. In other words, since part of the weight of the patient transport apparatus 10 would be lifted upon further deployment of the auxiliary wheels 62, the load on the auxiliary wheels 62 increases, and thus the load on the first actuation device 66*a* will increase thereby increasing the pressure in the hydraulic circuit 100 between the check valve 106 and the first actuation device 66*a*.

A pressure activated switch 108 is reactive to such changes in the pressure. The pressure activated switch 108 may be incorporated into the pump 102 or may be separate in the hydraulic circuit 100. The pressure activated switch 108 is configured to selectively divert hydraulic fluid to the first or second actuation devices 66*a*, 66*b*. When the pressure has reached a threshold, the switch 108 is automatically activated to divert hydraulic fluid from the first actuation device 66*a* to the second actuation device 66*b*. Thus, during operation, when the auxiliary wheels 62 reach the floor surface 41 such that additional load is now acting on the first actuation device 66*a*, the pressure in the hydraulic circuit 100 increases and the pressure activated switch 108 reacts by diverting the hydraulic fluid to the second actuation device 66*b*. The second actuation device 66*b* is designed to accommodate the additional load, as described below, and in some cases without requiring a substantial change in the amount of force to be applied by the user on the foot pedal 82. More specifically, in some cases, once the switch is activated to divert hydraulic fluid flow, the pressure is reduced owing to the second actuation device 66*b* having a different configuration than the first actuation device 66*a*. Once the hydraulic fluid is diverted to the second actuation device 66*b*, the drive rod 75*b* of the second actuation device 66*b* is thereafter displaced until a predefined distance is reached, until the end of its stroke, or otherwise.

In the embodiment shown in FIG. 5, the first actuation device 66*a* operates at a first pressure (e.g., created by load from opposing biasing device 124) to move the first drive rod 75*a* a first stroke distance to move the auxiliary wheels 62 from the stowed position to the first deployed position (e.g., the first stage of high travel/low force). The second actuation device 66*b* operates at a second pressure (e.g., created by load from weight of the patient transport apparatus 10 being lifted) to move the second drive rod 75*b* a second stroke distance to move the auxiliary wheels 62 from the first deployed position to the second deployed position (e.g., the second stage of low travel/high force). The second pressure may be greater than, less than, or substantially the same as the first pressure. The first stroke distance may be greater than, less than, or substantially the same as the second stroke distance. Generally, the first stroke distance is variable to accommodate variations in floor surfaces 41, but can be constant in some embodiments. The first stroke distance may be at least 0.30, 0.40, 0.50, 0.60, 1.0, or 2.0 inches or may range from 0.20 to 2.0 inches, from 0.40 to 1.0 inches, or from 0.50 to 0.80 inches. The second stroke distance may be variable or fixed. The second stroke distance may be at least 0.10, 0.13, 0.16, 0.20, 025 inches or may range from 0.05 to 0.50 inches, from 0.10 to 0.50 inches, or from 0.10 to 0.20 inches. In one embodiment, the second stroke distance is 0.16 inches so that the support wheels 54 are raised 0.25 inches off the floor surface 41 (assuming a level floor surface 41).

As previously mentioned, the first and second actuation devices 66*a*, 66*b* may be configured so that the user is able to apply a consistent force on the foot pedal 82 to cause the hydraulic fluid to move the auxiliary wheels 62 from the stowed position to the first deployed position, and then to the second deployed position, even though the loads acting on the first and second actuation devices 66*a*, 66*b* may be substantially different. This can be accomplished by sizing the first and second actuation devices 66*a*, 66*b* appropriately. For example, if the load acting on the second actuation device 66*b* is ten times larger than the load acting on the first actuation device 66*a*, then the surface area of the piston connected to the second drive rod 75*b* could be sized ten times larger than the surface area of the piston connected to the first drive rod 75*a*. As a result, for instance, if the pump 102 is a simple piston pump, then the same force applied by the user to the foot pedal 82 would operate both the first actuation device 66*a* and the second actuation device 66*b* (e.g., the same pressure would be present in the hydraulic circuit 100 in both the first stage and the second stage). At the same time, in this example, for the same displacement of the foot pedal 82, the second drive rod 75*b* would move in the second stage one tenth of the movement of the first drive rod 75*a* in the first stage.

In some cases, the first actuation device 66*a* is configured so that the first force required to be applied by the user to the foot pedal 82 to move the auxiliary wheels 62 from the stowed position to the first deployed position is less than the second force required to be applied by the user to the foot pedal 82 to move the auxiliary wheels 62 from the first deployed position to the second deployed position. For example, as previously discussed, a slight increase in the force being applied may be desirable to provide the user with tactile feedback indicating a transition between the first stage and the second stage so that the user is aware that the pair of support wheels 54 are being lifted off the floor surface 41.

A release valve 118 is present in the hydraulic circuit 100 to selectively control flow of the hydraulic fluid from the actuation devices 66*a*, 66*b* back to the reservoir 104. The release valve 118 is operatively coupled to the foot pedal 82 (or other input device). More specifically, in the embodiment shown, a mechanical linkage 115 couples the foot pedal 82 to the release valve 118 to selectively open or close the release valve 118 when the foot pedal 82 is moved. In other embodiments, a second hydraulic pump could be used to open or close the release valve 118. The release valve 118 opens fluid communication between the actuation devices 66*a*, 66*b* and the reservoir 104 upon movement of the foot pedal 82 back to the neutral position.

The release valve 118 may comprise a flow restrictor, check valve, or other components necessary to control/limit the flow of the hydraulic fluid. In some cases, a simple control valve may be employed to open/close fluid flow. In the embodiment shown, the release valve 118 comprises a variable orifice 120 that operates to control and restrict the flow of the hydraulic fluid back to the reservoir 104 once released. This controlled release acts to dampen the flow of the hydraulic fluid and thus avoid abrupt drops of the support wheels 54 that are raised off the floor surface 41 that would otherwise occur owing to the weight of the patient transport apparatus 10 acting on the auxiliary wheels 62.

When the release valve 118 is opened, the auxiliary wheels 62 move from the second deployed position to the first deployed position under the weight of the patient and/or the other components of the patient transport apparatus 10 being supported by the auxiliary wheels 62. More specifically, when the release valve 118 is opened, pressure in the hydraulic circuit 100 between the first and the second actuation devices 66*a*, 66*b* and the release valve 118 is released causing hydraulic fluid to flow from the first and the second actuation devices 66*a*, 66*b* to the release valve 118 and through the orifice 120 (the pressure activated switch 108 also resets to its original position). A stowing device, such as the biasing device 124 (see FIG. 2A), is arranged between the base 14 and the carriage and/or the deployment arms 63 to return the auxiliary wheels 62 from the first deployed position to the stowed position when the release valve 118 is opened. The biasing device 124 may comprise a tension spring, torsion spring, or other suitable biasing device.

A hydraulic accumulator 109 may be in fluid communication with the second actuation device 66*b* in the hydraulic circuit 100 to provide suspension during transport of the patient on the patient transport apparatus 10. In other versions, the hydraulic accumulator 109 is absent.

A locking device 110 may be used to lock the auxiliary wheels 62 in the second deployed position when the foot pedal 82 is at the second stage (see FIGS. 3A-3C). The locking device 110 comprises a locking element 112 and a biasing device 114 that biases the locking element 112 toward a locked state. The biasing device 114 may comprise a torsion spring or other suitable element. The locking element 112 is pivotally connected to the base 14 to act on the foot pedal 82 when the foot pedal 82 is moved to the second stage.

As the foot pedal 82 moves from the first stage to the second stage, the foot pedal 82 engages a camming surface of the locking element 112 and pivots the locking element 112 against the bias of the biasing device 114 until the foot pedal 82 passes under a catch of the locking element 112. Thereafter, the locking element 112 is biased into the locked state to hold the foot pedal 82 in the second stage. The foot pedal 82 may also be separately biased by a biasing device (e.g., a second torsion spring) that biases the foot pedal 82 toward the neutral, disengaged position. A release pedal 116 is fixed to the locking element 112 to release the locking element 112 upon actuation by the user. Other suitable locking devices 110 are also contemplated and may be integrated into other components, such as the pump 102, actuation devices 66*a*, 66*b*, or the like.

Figure 6A:
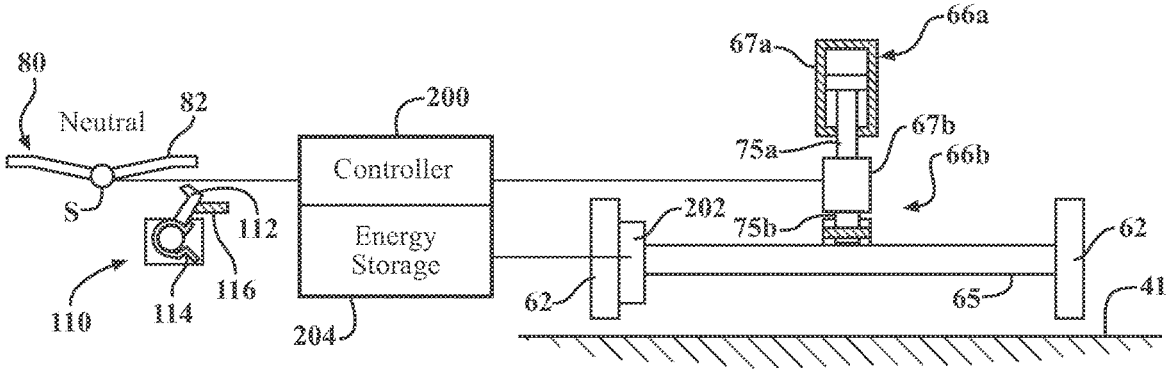
FIGS. 6A-6C illustrate deployment of the auxiliary wheel assembly with two different types of actuators in series.
Figure 6B:
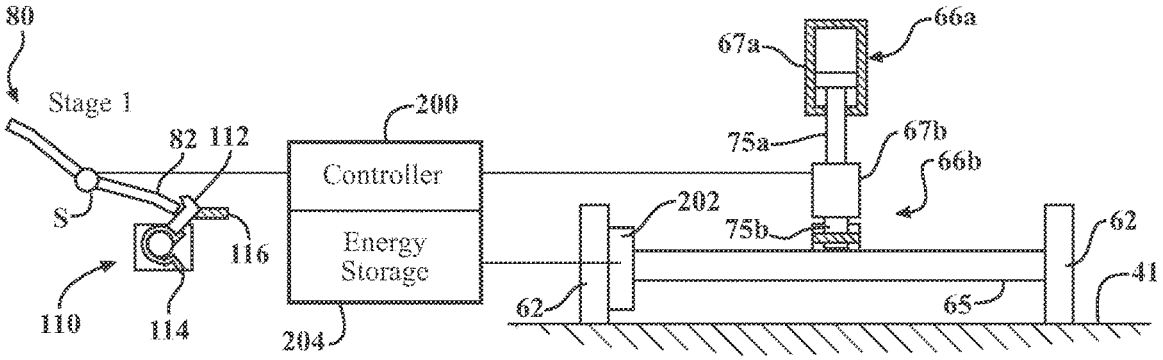
Figure 6C:
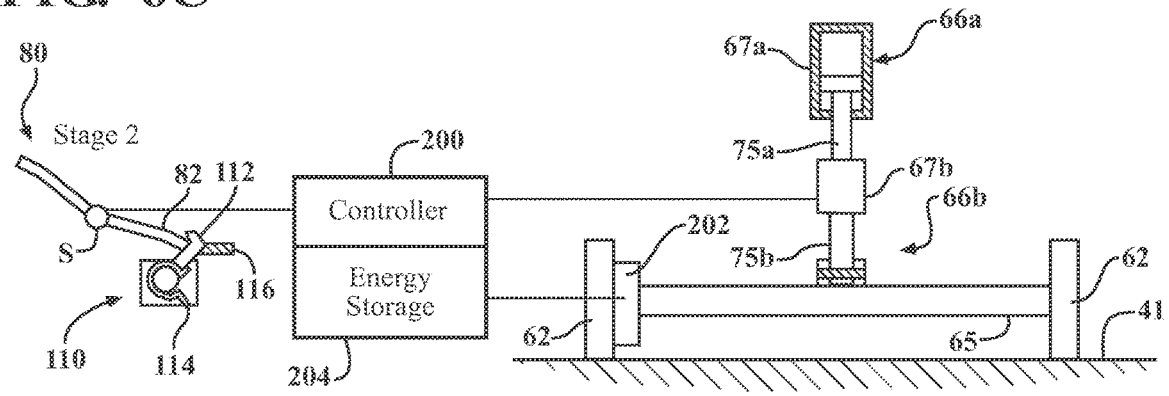

Referring to FIGS. 6A-6C, in another embodiment, the first and second actuation devices 66*a*, 66*b* comprise different types of actuation devices. For example, as shown, the first actuation device 66*a* comprises a first hydraulic actuator, similar to the embodiments previously described, and the second actuation device 66*b* comprises an electrically powered actuator. The second actuation device 66*b* may comprise a rotary actuator, linear actuator, or any other suitable actuator. In the embodiment shown here, the second actuation device 66*b* is an electrically-powered linear actuator. A suitable actuator comprises a linear actuator supplied by LINAK A/S located at Smedevenget 8, Guderup, DK-6430, Nordborg, Denmark. It is contemplated that any suitable actuator capable of deploying the auxiliary wheels 62 may be utilized.

In this embodiment, the control system 80 comprises a controller 200 having one or more microprocessors for processing instructions or for processing algorithms stored in memory to control operation of the second actuation device 66*b* and/or other powered devices. Additionally or alternatively, the controller 200 may comprise one or more microcontrollers, field programmable gate arrays, systems on a chip, discrete circuitry, and/or other suitable hardware, software, or firmware that is capable of carrying out the functions described herein. The memory may further store one or more look-up tables that define control parameters of the second actuation device 66*b* and other powered devices. The controller 200 may be carried on-board the patient transport apparatus 10, or may be remotely located. In one embodiment, the controller 200 is mounted to the base 14.

A generator 202 and energy storage device 204 (e.g., battery, capacitor, etc.) provides power for the second actuation device 66*b* and the controller 200. The generator 202 and the energy storage device 204 are coupled to the controller 200. The generator 202 is operatively coupled to one or more of the auxiliary wheels 62 to generate electricity in response to rotation of the auxiliary wheels 62. For instance, after the first actuation device 66*a* (e.g., the first hydraulic actuator) moves the auxiliary wheels 62 from the stowed position to the first deployed position in the same manner as previously described, the auxiliary wheels 62 contact the floor surface 41. By virtue of being in contact with the floor surface 41, the auxiliary wheels 62 are able to rotate when the user begins to move the patient transport apparatus 10. As the auxiliary wheels 62 rotate, electricity is being generated and stored in the energy storage device 204. See, for example, U.S. patent application Ser. No. 16/168,089, filed Oct. 23, 2018, entitled, "Techniques For Power Transfer Through Wheels Of A Patient Support Apparatus," and U.S. patent application Ser. No. 16/168,212, filed Oct. 23, 2018, entitled, "Energy Harvesting And Propulsion Assistance Techniques For A Patient Support Apparatus," both of which describe the use of wheels in generating and storing energy for patient transport apparatuses, the disclosures of both are hereby incorporated herein by reference.

At the same time that energy is being stored, portions of the energy is being used by the controller 200 to actuate the second actuation device 66*b*. The controller 200 is coupled to the second actuation device 66*b* in a manner that allows the controller 200 to control the second actuation device 66*b*. The controller 200 may communicate with the second actuation device 66*b* via wired or wireless connections. The controller 200 generates and transmits control signals to the second actuation device 66*b*, or components thereof, to cause the second actuation device 66*b* to perform one of more desired movements or functions. The controller 200 may monitor an actual state of the second actuation device 66*b* and determine desired states to which the second actuation device 66*b* should be placed, based on one or more input signals that the controller 200 receives from one or more input devices. The state of the second actuation device 66*b* may be a position, a relative position, a speed, a force, a load, a current, an energization status (e.g., on/off), or any other parameter of the second actuation device 66*b*. The input devices used to control operation of the second actuation device 66*b* comprises user input devices, such as the foot pedal 82 and/or one or more sensors S in communication with (e.g., coupled to) the controller 200. The sensors S may be position sensors, such as potentiometers, encoders, hall-effect sensors, accelerometers, and the like.

In this embodiment, instead of the user providing the applied forces on the foot pedal 82 required to move the auxiliary wheels 62 from the stowed position (against the biasing device 124) to the first deployed position, and further to the second deployed position, the user is only required to move the foot pedal to the first stage (in this embodiment the locking device 110 locks the foot pedal 82 after movement to the first stage as shown). The controller 200 handles the second stage automatically. In the embodiment shown, the sensor S detects rotation of the foot pedal 82 to the first stage. The controller 200 receives the corresponding signal from the sensor S that then causes the second actuation device 66*b*, e.g., the electric linear actuator, to operate and further move the auxiliary wheels 62 to the second deployed position.

This movement to the second deployed position could occur over a predetermined period of time, e.g., 5, 10, 15, 20, 60, 120 seconds, or less. This movement could also begin immediately after the foot pedal 82 has been moved to the first stage, or could be delayed for a predetermined period of time, e.g., 5, 10, 15, 20, 60, 120 seconds, or less. Movement of the auxiliary wheels 62 from the first deployed position to the second deployed position may also be triggered by and/or occur during rolling of the auxiliary wheels 62, which can be detected based on whether the generator 202 is generating electricity or via an accelerometer or other movement sensor. Once the second deployed position is reached, the controller 200 discontinues operation of the second actuation device 66*b*.

Other mechanisms are also contemplated that move the auxiliary wheels 62 from the first deployed position to the second deployed position in response to rolling of the auxiliary wheels 62 along the surface whereby rolling of the auxiliary wheels 62 along the surface generates energy at least partially used by the actuator system 66 to move the auxiliary wheels 62 from the first deployed position to the second deployed position.

In another embodiment, three actuation devices may be employed. The first and second actuation devices 66*a*, 66*b* may comprise the combination of the first and second hydraulic actuators as previously described and the third actuation device comprises the electrically powered actuator as previously described. In this embodiment, the first and second actuation devices 66*a*, 66*b* operate in the same manner described, but to a first deployed position in which the auxiliary wheels 62 are deployed such that the pair of support wheels 54 are lifted only slightly off the floor surface 41, such as from 0.01 to 0.10 inches off the floor surface 41, i.e., the auxiliary wheels 62 are not fully deployed. Again, the user depresses the foot pedal 82 to actuate the first and second actuation devices 66*a*, 66*b* to only slightly lift the pair of support wheels 54 off the floor surface. The third actuation device then operates automatically in the same manner described above to further move the auxiliary wheels to the second deployed position. By having the user actuate the foot pedal 82 to at least slightly lift the pair of support wheels 54 off the floor surface 41, then the auxiliary wheels 62 may make better contact with the floor surface 41 and provide better maneuverability of the patient transport apparatus 10 than if the auxiliary wheels 62 only make initial contact with the floor surface 41, but without substantially increasing the amount of work required to be input by the user (and without additional time spent by the user to further deploy the auxiliary wheels 62)—the third actuation device automatically provides the additional work required to move the auxiliary wheels 62 to the fully deployed position.

It is to be appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient transport apparatus for transporting a patient over a surface, the patient transport apparatus comprising:

a support structure comprising a base and a patient support surface;

support wheels coupled to the base;

an auxiliary drive assembly coupled to the support structure and comprising an auxiliary driver movable relative to the base from a stowed position to a first deployed position and further to a second deployed position, the stowed position being spaced from the surface and the second deployed position being in contact with the surface; and an actuator system operatively coupled to the auxiliary driver and configured to move the auxiliary driver relative to the base from the stowed position to the first deployed position and further to the second deployed position, the actuator system comprising:

a first actuation device operable to move the auxiliary driver from the stowed position to the first deployed position in a first stage of the auxiliary driver, and a second actuation device operable to move the auxiliary driver from the first deployed position to the second deployed position in a second stage of the auxiliary driver, wherein each of the first and second actuation devices is operable separately from the other of the first and second actuation devices to move the auxiliary driver.

2. The patient transport apparatus of claim 1, wherein the actuator system is configured to sequence operation of the actuation devices such that the first actuation device is initially operated to move the auxiliary driver from the stowed position to the first deployed position in the first stage of the auxiliary driver, and upon the auxiliary driver reaching the first deployed position, the second actuation device is operated to move the auxiliary driver from the first deployed position to the second deployed position in the second stage of the auxiliary driver.

3. The patient transport apparatus of claim 1, wherein the actuator system is configured to operate the first actuation device to move the auxiliary driver in the first stage from the stowed position to the first deployed position at a first actuation rate and to operate the second actuation device in the second stage to move the auxiliary driver from the first deployed position to the second deployed position at a second actuation rate, slower than the first actuation rate.

4. The patient transport apparatus of claim 1, wherein the first actuation device is configured to move the auxiliary driver a first distance relative to the base in the first stage and the second actuation device is configured to move the auxiliary driver a second distance relative to the base in the second stage, the first distance being greater than the second distance.

5. The patient transport apparatus of claim 1, wherein the auxiliary driver is configured to be spaced from the surface in the stowed position, and the auxiliary driver is configured to be in contact with the surface in the first deployed position and the second deployed position.

6. The patient transport apparatus of claim 5, wherein:

the first actuation device comprises a first hydraulic actuator operable to move a first stroke distance to move the auxiliary driver from the stowed position to the first deployed position in the first stage of the auxiliary driver, the second actuation device comprises a second hydraulic actuator operable to move a second stroke distance to move the auxiliary driver from the first deployed position to the second deployed position in the second stage of the auxiliary driver, the first stroke distance being greater than the second stroke distance, and wherein the first stroke distance is variable and the second stroke distance is one of variable or fixed.

7. The patient transport apparatus of claim 6, wherein the first and second hydraulic actuators are connected to the auxiliary drive assembly in series or parallel.

8. The patient transport apparatus of claim 6, wherein the actuator system further comprises an input device operatively coupled to the first and second actuation devices to receive input from a user; and wherein the actuator system comprises a hydraulic pump operatively coupled to the input device, the hydraulic pump configured to transmit hydraulic fluid to the first hydraulic actuator and to the second hydraulic actuator in response to the input device being moved from a disengaged state to an engaged state by the user.

9. The patient transport apparatus of claim 8, comprising a pressure activated switch configured to selectively provide fluid communication between the hydraulic pump and the first or second hydraulic actuators.

10. The patient transport apparatus of claim 8, comprising a release valve with a variable orifice, the release valve being operatively coupled to the input device to release hydraulic fluid from the second hydraulic actuator upon movement of the input device from the engaged state to the disengaged state to move the auxiliary driver from the second deployed position to the first deployed position.

11. The patient transport apparatus of claim 8, comprising a locking device configured to lock the auxiliary driver in the second deployed position when the input device is in the engaged state.

12. The patient transport apparatus of claim 8, comprising a biasing device operatively coupled to the auxiliary driver to return the auxiliary driver from the first deployed position to the stowed position.

13. The patient transport apparatus of claim 8, comprising a hydraulic accumulator in fluid communication with the second hydraulic actuator.

14. The patient transport apparatus of claim 1, wherein the second actuation device is configured to move the auxiliary driver from the first deployed position to the second deployed position in response to rolling of the auxiliary driver along the surface whereby rolling of the auxiliary driver along the surface generates energy at least partially used by the actuator system to move the auxiliary driver from the first deployed position to the second deployed position.

15. The patient transport apparatus of claim 1, wherein the actuator system further comprises an input device operatively coupled to the first and second actuation devices to receive input from a user; and wherein the input device is configured to receive an applied force from a user and transmit the applied force into the actuator system to move the auxiliary driver from the stowed position to the first deployed position and further to the second deployed position.

16. The patient transport apparatus of claim 15, wherein the first actuation device is configured so that a first force is required to be applied by the user to the input device to move the auxiliary driver from the stowed position to the first deployed position and the second actuation device is configured so that a second force is required to be applied by the user to the input device to move the auxiliary driver from the first deployed position to the second deployed position, wherein the first force is substantially the same as the second force.

17. The patient transport apparatus of claim 15, wherein the actuation devices are configured so that a force required to be applied by the user to the input device to move the auxiliary driver from the stowed position to the first deployed position and further to the second deployed position remains substantially constant.

18. The patient transport apparatus of claim 1, wherein the auxiliary driver is further defined as a first auxiliary driver; and wherein the auxiliary drive assembly comprises a second auxiliary driver with the first and second auxiliary drivers being configured to collectively support fifty percent or less of a total mass of the patient transport apparatus in the first deployed position and greater than fifty percent of the total mass in the second deployed position.

19. The patient transport apparatus of claim 1, wherein the actuator system is configured to operate the first and second actuation devices simultaneously.

* * * * *